United States Patent [19]

Inagaki et al.

[11] 4,397,620

[45] Aug. 9, 1983

[54] ROTARY BLADED COMPRESSOR WITH SEALING GAPS AT THE ROTARY ENDS

[75] Inventors: Mitsuo Inagaki; Hideaki Sasaya, both of Okazaki, Japan

[73] Assignee: Nippon Soken, Inc., Nishio, Japan

[21] Appl. No.: 256,250

[22] Filed: Apr. 21, 1981

[51] Int. Cl.[3] ..... F04C 18/00; F04C 27/00

[52] U.S. Cl. ..... 418/141; 418/259

[58] Field of Search ..... 418/255, 259, 102, 141

[56] References Cited

U.S. PATENT DOCUMENTS

| | | | |
|---|---|---|---|
| 600,677 | 3/1898 | Moore et al. | 418/255 |
| 992,929 | 5/1911 | Winans et al. | 418/255 |
| 1,715,629 | 6/1929 | Shore | 418/255 |
| 2,314,056 | 3/1943 | Sobek | 418/255 |
| 2,400,286 | 5/1946 | Buckbee | 418/141 |

FOREIGN PATENT DOCUMENTS

| | | | |
|---|---|---|---|
| 1086006 | 7/1960 | Fed. Rep. of Germany | 418/141 |

*Primary Examiner*—John J. Vrablik

*Attorney, Agent, or Firm*—Cushman, Darby & Cushman

[57] ABSTRACT

A rotary compressor including two rotary disc-shaped members having a diameter slightly smaller than that of a rotor each disposed on opposite ends of the rotor and supported on the same rotary shaft as the rotor for rotation, and two disc-shaped recesses each formed on one of inner opposite end surfaces of a housing for receiving therein one of the plurality of rotary disc-shaped members. A small gap is formed between the inner end surfaces of the housing and the end surfaces of the rotor, and small gaps are formed between surfaces of the rotary disc-shaped members and surfaces of the disc-shaped recesses. The area through which a fluid leaks from the high pressure side to the low pressure side in the housing is minimized, and resistance is offered by the tortuous path to the flow of the fluid toward the rotary shaft, to thereby minimize the leakage of fluid during operation of the compressor.

2 Claims, 7 Drawing Figures

ROTARY BLADED COMPRESSOR WITH SEALING GAPS AT THE ROTARY ENDS

BACKGROUND OF THE INVENTION

This invention relates to rotary compressors, and more particularly it is concerned with a rotary compressor of the type suitable for use with an air conditioning system for an automotive vehicle for compressing a refrigerant.

In this type of rotary compressor, it has hitherto been usual practice to arrange the rotor with respect to the housing in such a manner that the end surfaces of the rotor and the inner end surfaces of the housing form therebetween a small gap (in the range between 0.02 and 0.03 mm). When this gap is too small, the end surfaces of the rotor would be brought into contact with the inner end surfaces of the housing due to thermal expansion during operation of the compressor, causing seizure to develop. Meanwhile, when the gap is too large, the compressor would have reduced efficiency because the refrigerant in the space on the high pressure side would pass through the gap to the space on the low pressure side. In view of this situation, various proposals have hitherto been made in this type of rotary compressor to enable the compressor to operate in satisfactory condition while keeping the aforementioned gap at a small value. However, all the proposals that have ever been made have been unable to attain the end of enabling a rotary compressor to operate with a high degree of efficiency with a small gap interposed between the end surfaces of the rotor and the inner end surfaces of the housing.

SUMMARY OF THE INVENTION

This invention has as its object the provision of a rotary compressor wherein the fluid in the space on the high pressure side is prevented from passing through a gap between the rotor and the housing to the space on the low pressure side and wherein the fluid under high pressure is prevented from leaking and passing to the rotary shaft, to thereby maintain the efficiency of the rotary compressor at a high level.

The aforesaid object can be accomplished by characterizing features of the invention including rotary disc-shaped members of a diameter slightly smaller than that of the rotor mounted on the same shaft as the rotor on opposite ends thereof for rotation as a unit therewith, disc-shaped recesses formed on opposite inner ends of the cylindrical housing for receiving the rotary disc-shaped members, a small gap defined between the end surfaces of the rotor outwardly of the rotary disc-shaped member and the inner end surfaces of the housing, and gaps defined between the surfaces of the rotary disc-shaped members and the surfaces of the disc-shaped recesses. By virtue of these features, the area through which the fluid on the high pressure side leaks to the low pressure side can be minimized and resistance is offered to the flow of the fluid toward the rotary shaft, so that the fluid leakage inside the rotary compressor during operation can be minimized to enable an increase in efficiency to be achieved.

DESCRIPTION OF THE PREFERRED EMBODIMENTS

Figure 1:
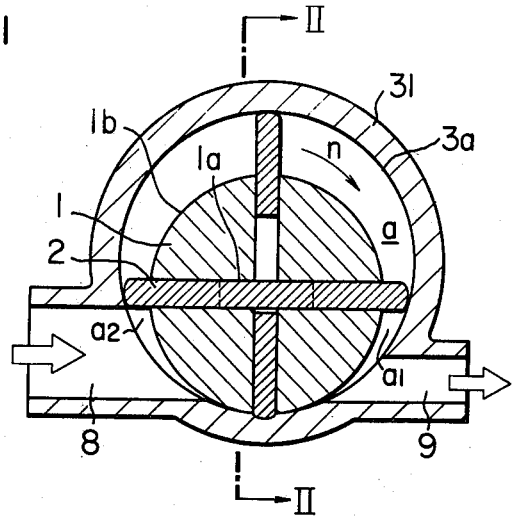
FIG. 1 is a sectional view of the rotary compressor comprising an embodiment of the invention.

The invention will now be described by referring to the embodiments shown in the accompanying drawings. In FIG. 1 which is a sectional view of one embodiment of the rotary compressor in conformity with the invention, movable blades 2 are slidably fitted in grooves 1*a* formed in a rotor 1 each having opposite ends maintained in sliding contact with an inner surface 3*a* of a housing member 31 in such a manner that the sliding positions thereof are regulated by the shape and configuration of the inner surface 3*a*. With the rotor 1 being eccentrically arranged within the housing 31, spaces a defined by an outer periphery 1*b* of the rotor 1, the movable blades 2 and the housing inner surface 3*a* undergo contraction and expansion as the rotor 1 rotates in the direction of an arrow n, so that a refrigerant is drawn by suction through an inlet port 8 from an evaporator, not shown, compressed in each cylindrical space a and discharged through an outlet port 9 to be supplied to a condenser, not shown.

Figure 2:
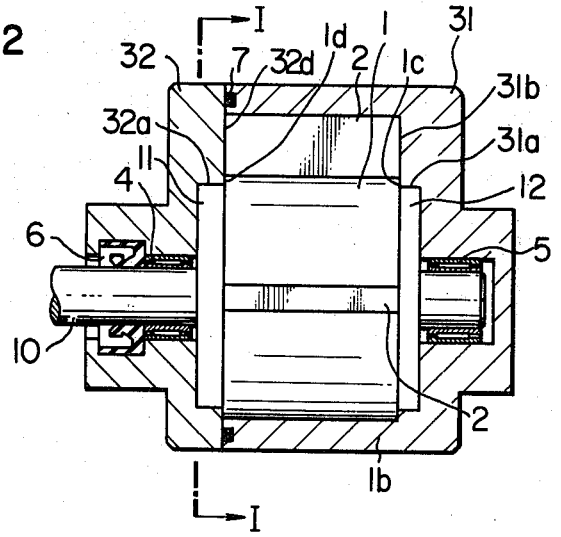
FIG. 2 is a sectional view taken along the line II—II in FIG. 1.

Referring to FIG. 2, the rotor 1 is journaled by bearings 4 and 5 mounted in housing members 32 and 31 respectively and driven by a rotary shaft 10 by motive force supplied from outside, such as an engine of an automotive vehicle. A shaft seal 6 is mounted between the rotary shaft 10 and the bearing 4, to avoid outflow of the refrigerant along the rotary shaft 10. A seal 7 is mounted between the two housing members 31 and 32 which are connected together by bolts, not shown, to provide a housing.

Located between the rotor 1 and the bearings 4 and 5 are rotary disc-shaped members 11 and 12 formed of chrominum-molybdenum steel for rotation with the rotor 1 as a unit. The rotary disc-shaped members 11 and 12 each have an outer diameter slightly smaller than that of the rotor 1. When the rotor 1 has a diameter of 50 mm, for example, the disc-shaped members 11 and 12 may have a diameter of 46 mm. Meanwhile the housing members 31 and 32 are formed on inner surfaces thereof with disc-shaped recesses 31*a* and 32*a* for receiving the disc-shaped members 12 and 11 in enclosing relation in such a manner that a small gap $L_1$ (see FIG. 5) is defined between annular walls of the disc-shaped recesses 31*a* and 32*a* and the rotary disc-shaped members 12 and 11 respectively. The gap $L_1$ may be in the range between 0.02 and 0.03 mm, for example. Another gap $L_2$ (see FIG. 5) is defined between end surfaces 1*c* and 1*d* of the rotor 1 and the housing members 31 and 32 disposed in spaced juxtaposed relation. The gap $L_2$ may be in the range between 0.04 and 0.05 mm, for example. Still another gap $L_3$ (see FIG. 5) is defined between end surfaces 11*a* and 12*a* of the disc-shaped members 11 and 12 and end surfaces 31*b* and 32*b* of the housing members 31 and 32 respectively disposed in spaced juxtaposed relation. The gap $L_3$ may be in the range between 0.04 and 0.05 mm, for example.

Figure 3:
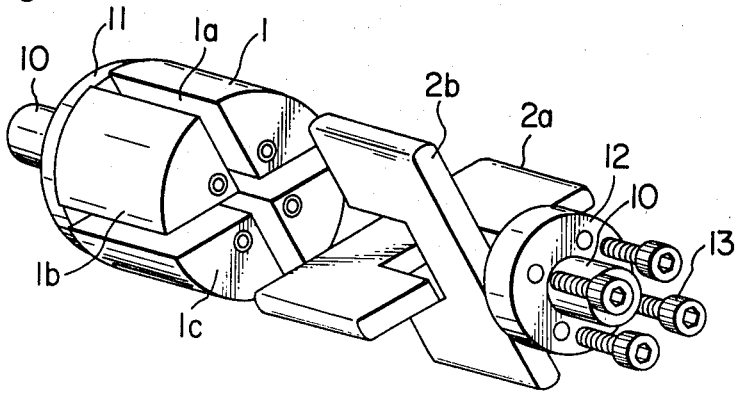
FIG. 3 is an exploded perspective view of the rotor with movable blades showing the manner of its assembling in the compressor shown in FIG. 1.

FIG. 3 is an exploded perspective view showing the manner in which the rotor 1, movable blades 2 and rotary disc-shaped members 11 and 12 of the aforesaid construction are assembled into a unitary structure. As shown in this figure, the movable blades 2*a* and 2*b* are substantially in the form of a letter U and inserted in the grooves 1*a* formed in the rotor 1 from the end surface 1*c* while the two movable blades 2*a* and 2*b* are arranged in intersecting relation. Following insertion of the movable blades 2*a* and 2*b* in the grooves 1*a*, the rotary disc-shaped member 12 is secured to the end surface 1*c* by bolts 13, thereby completing the assembling of the rotor 1. The disc-shaped member 11 located on the other end surface 1*d* of the rotor 1 is formed integrally with the rotor 1 and the rotary shaft 10.

Figure 4:
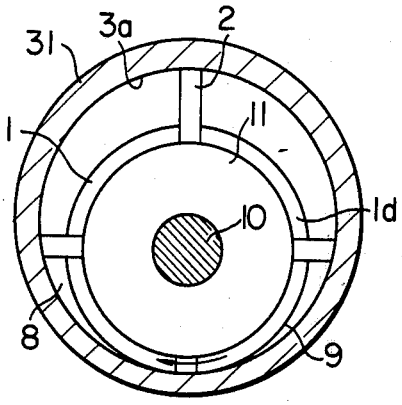
FIG. 4 is a sectional view taken along the line IV—IV in FIG. 2.

In the rotary compressor according to the invention, the rotary disc-shaped members 11 and 12 are arranged on the end surfaces 1*d* and 1*c* of the rotor 1 and enclosed by the disc-shaped recesses 32*a* and 31*a* formed on the inner surfaces of the housing members 32 and 31 respectively. By virtue of this structural arrangement, a current of refrigerant flowing from the space a on the higher pressure side to the space a on the low pressure side only passes between outer peripheries of the rotary disc-shaped members 11 and 12 and the outer periphery 1*b* of the rotor 1 at the end surfaces 1*c* and 1*d* of the rotor 1 as shown in FIG. 4. Thus the volume of the refrigerant leaking from the high pressure side to the low pressure side in the rotary compressor according to the invention is markedly reduced in comparison with the corresponding volume of the refrigerant in rotary compressors of the prior art in which the leakage of refrigerant takes place through the entire zone at the end surfaces of the rotor. This enables the refrigerant drawn by suction into the cylindrical spaces a through the inlet port 8 to be discharged into the outlet port 9 with a high degree of efficiency, to thereby permit the compressor to operate in excellent operating condition.

One might consider that the leakage of refrigerant could be further reduced by rendering the diameter of the rotary disc-shaped members 11 and 12 equal to that of the rotor 1. This is not the case however, because another trouble occurs when the diameter of the rotary disc-shaped members 11 and 12 is equal to that of the rotor 1. It has been ascertained that better results can be achieved by rendering the diameter of the rotary disc-shaped members 11 and 12 slightly smaller than that of the rotor 1. The reason why this happens will now be explained.

As described hereinabove, the gaps $L_2$ and $L_3$ of 0.04–0.05 mm are formed between the end surface 32*b* of the housing member 32 and the end surface 1*d* of the rotor 1 and between the end surface 32*b* of the housing member 32 and the end surface 11*a* of the rotary disc-shaped member 11 respectively. These gaps are intended to accommodate thermal expansion of the rotor 1 and disc-shaped members 11 and 12 and avoid wobbling of the end surfaces 1*c*, 1*d*, 11*a* and 12*a* of the rotor 1 and disc-shaped members 11 and 12 that might occur at the time of rotation because of a possible error committed in producing these parts which might result in the end surfaces 1*c*, 1*d*, 11*a* and 12*a* not being perpendicular to the axis of the rotary shaft 10.

The gap $L_1$ of about 0.02–0.03 mm is provided between the annular wall of the disc-shaped recesses 32*a* of the housing member 32 and the disc-shaped member 11 as described above. This gap is intended to accommodate deformation of the bearings 4 and 5 and prevent the rotary disc-shaped members 11 and 12 from being brought into contact with the annular walls of the disc-shaped recesses 32*a* and 31*a* respectively.

Figure 5:
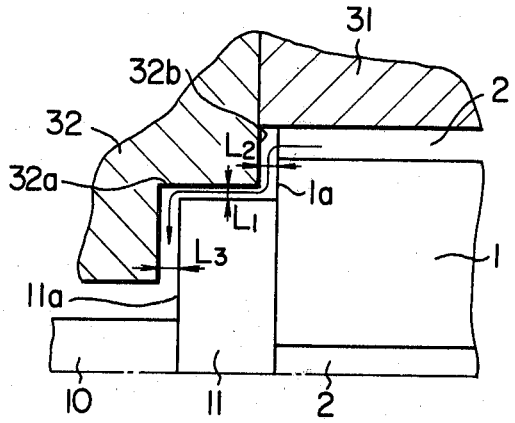
FIG. 5 is a sectional view of the essential portions of the compressor shown in FIG. 1.

In the rotary compressor of the aforesaid construction, the refrigerant in the cylindrical spaces a flows, as shown in FIG. 5, through the gaps $L_2$, $L_1$ and $L_3$ in leaking toward the rotary shaft 10. However, with the aforesaid distinction in diameter between the rotor 1 and the disc-shaped members 11 and 12, a current of refrigerant tending to flow toward the rotary shaft 10 suffers resistance to its flow offered by the structural relation between the rotor 1, disc-shaped members 11 and 12, disc-shaped recesses 31*a* and 32*a* and the housing members 31 and 32 which causes the current of refrigerant to change the direction of its flow at right angles as shown in FIG. 5. In the rotary compressor according to the invention, the volume of the refrigerant flowing past the end surfaces 1*c* and 1*d* of the rotor 1 can be sufficiently reduced to make the rotor suitable for practical use even if the gaps $L_2$ and $L_3$ are relatively large, by virtue of the aforesaid structural distinctions provided by the invention.

In the event that the rotary disc-shaped members 11 and 12 have diameter equal to that of the rotor 1, the refrigerant would flow quickly to toward the rotary shaft 10 because the path of flow would not have its direction changed and would flow straight and the gap $L_3$ is relatively large (0.04–0.05 mm) between the rotary disc-shaped member 11 and the disc-shaped recess 32*a* of the housing member 32.

Figure 6:
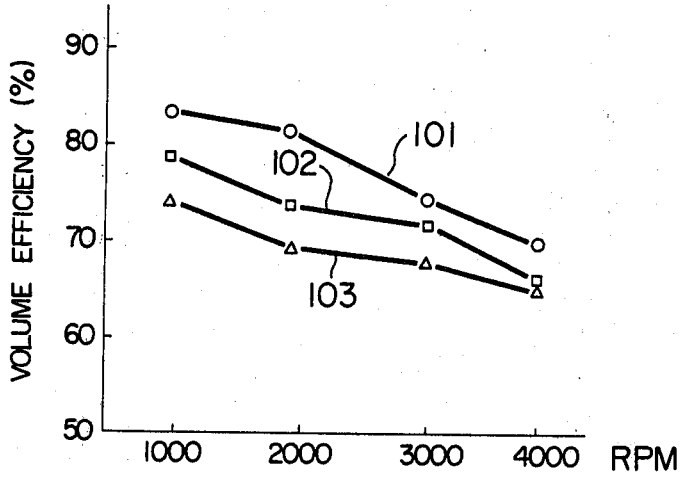
FIG. 6 is a view in explanation of the effects achieved by the compressor according to the invention.

The rotary compressor having the aforesaid structural relationship according to the invention was manufactured and tested for its volume efficiency. FIG. 6 shows the results of such test.

In FIG. 6, there is shown a graph in which the ordinate represents the volume efficiency and the abscissa indicates the RPMs of the rotary compressor. In the graph, a curve 101 represents the characteristic of the rotary compressor according to the invention; a curve 102 represents the characteristic of a rotary compressor which is substantially similar to the rotary compressor according to the invention except that the rotary disc-shaped member 11 has a diameter equal to that of the rotor 1; and a curve 103 represents the characteristic of a rotary compressor of the prior art. The rotary compressor of the prior art used in the test had a gap of 0.02–0.03 mm defined between the end surfaces of the rotor and the end surfaces of the housing.

It will be clearly seen in FIG. 6 that the rotary compressor according to the invention has excellent volume efficiency due to the facts that the volume of refrigerant leaking from the space $a_1$ on the high pressure side to the space $a_2$ is small and that the volume of refrigerant leaking past the end surfaces 1*c* and 1*d* of the rotor 1 toward the rotary shaft 10 is small.

Figure 7:
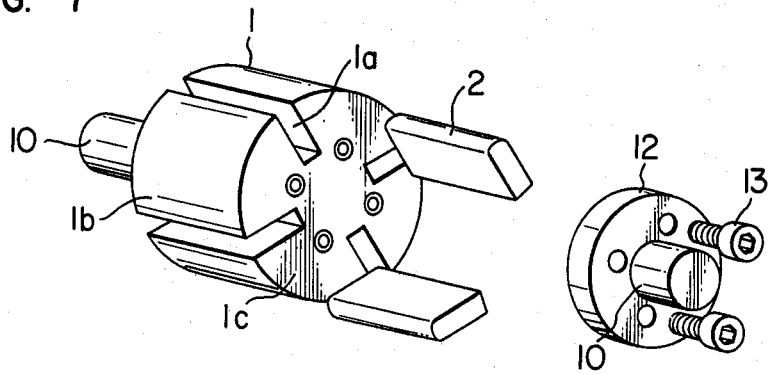
FIG. 7 is a perspective view of the rotary compressor comprising another embodiment.

In the embodiment shown and described hereinabove, the grooves 1*a* formed in the rotor 1 extend therethrough to allow the movable blades 2 inserted in the grooves 1*a* to be brought into contact at their opposite ends with the inner surfaces 3*a* of the housing 31, 32. In another embodiment shown in FIG. 7, the grooves 1*a* do not extend through the rotor 1 but have a predetermined depth and have the movable blades 2 inserted therein for sliding movement.

In the foregoing description of the embodiments, the invention has been described as handling a refrigerant to be compressed. However, it is to be understood that the invention is not limited to this specific use and that the rotary compressor according to the invention may be used for compressing any other fluid as desired.

What is claimed is:

1. A rotary blade compressor with sealing gaps at the rotor ends comprising:

a cylindrical housing having an inner peripheral surface and inner end surfaces;

a cylindrical rotor eccentrically supported in said cylindrical housing, said cylindrical rotor being formed with a plurality of grooves; and a plurality of movable blades each slidably fitted in one of said plurality of grooves in said cylindrical rotor and contacting said inner peripheral surfaces of said cylindrical housing to define a plurality of spaces for compressing a fluid; the improvement comprising:

two rotary disc-shaped members located on one of opposite end surfaces of said cylindrical rotor, said rotary disc-shaped members being of a diameter slightly smaller than that of said cylindrical rotor;

two disc-shaped recesses each formed on one of said inner end surfaces of said cylindrical housing for receiving one of said plurality of rotary disc-shaped members;

first gaps respectively defined between annular walls of said recesses and cylindrical outer surfaces of said rotary disc-shaped members;

second gaps respectively defined between outer end surfaces of said cylindrical rotor and the inner end surfaces of said cylindrical housing; and third gaps respectively defined between outer end surfaces of said disc-shaped members and the inner end surfaces of said recesses, said first gaps being smaller than said second and third gaps.

2. A rotary compressor as claimed in claim 1, wherein said first gaps are in a range of from 0.02 mm to 0.03 mm and said second and third gaps are in a range of from 0.04 mm to 0.05 mm.

* * * * *